United States Patent [19]

Chang et al.

[11] Patent Number: 4,845,510

[45] Date of Patent: Jul. 4, 1989

[54] REFLECTOR SURFACE ADJUSTMENT STRUCTURE

[75] Inventors: Stanley S. Chang, Palos Verdes Estates; Amilcar B. Ybarra-Rojas, Anaheim Hills; Hui Bau, Hermosa Beach, all of Calif.

[73] Assignee: Hughes Aircraft Company, Los Angeles, Calif.

[21] Appl. No.: 83,489

[22] Filed: Aug. 10, 1987

[51] Int. Cl.[4] ..... H01Q 15/20

[52] U.S. Cl. ..... 343/880; 343/915

[58] Field of Search ..... 343/878–880, 343/885, 912, 840, 914–916; 403/24, 167, 168

[56] References Cited

U.S. PATENT DOCUMENTS

| | | | |
|---|---|---|---|
| 3,105,969 | 10/1963 | Banche et al. | 343/915 |
| 3,383,692 | 5/1968 | Laibson et al. | 343/781 |
| 3,401,390 | 9/1968 | Braccini et al. | 343/915 |
| 3,898,667 | 8/1975 | Raab | 343/840 |
| 4,650,361 | 3/1987 | Seuster | 343/915 |
| 4,731,144 | 3/1988 | Kommineni et al. | 343/912 |

FOREIGN PATENT DOCUMENTS

| | | | |
|---|---|---|---|
| 112104 | 7/1982 | Japan | 343/880 |
| 1252844 | 8/1986 | U.S.S.R. | |

*Primary Examiner*—Rolf Hille
*Assistant Examiner*—Michael C. Wimer
*Attorney, Agent, or Firm*—Mark J. Meltzer; A. W. Karambelas

[57] ABSTRACT

Rear and forward reflector shells or dishes (36,38) are independently supported on a dynamically rigid truss structure (12) by means of separate studs extending from the forward nodes of the truss to the two shells. Forward node (22) carries adjustable rear shell stud (52) and independently carries adjustable forward shell stud (80). Both of the studs have flat portions oriented normal to the radius of the shell so that radial shell expansion due to temperature and temperature differential minimize shell distortion.

14 Claims, 3 Drawing Sheets

REFLECTOR SURFACE ADJUSTMENT STRUCTURE

FIELD OF THE INVENTION

This invention regards a structure which permits adjustment of the reflector surface of a reflector as the last manufacturing step and minimizes distortion of the reflector surface upon temperature changes and temperature differential. The adjustment structure is particularly useful for the adjustment of two surfaces which lie within the curvature of each other so they are nested together.

BACKGROUND OF THE INVENTION

Reflector shells are used to reflect and focus radio-frequency energy radiating from a feed. In order to correctly focus the energy, the shape of the reflector shell must initially be close to the theoretical shape, and it must maintain its contour over changes in temperature and changes in temperature differential across the reflector surface.

In previous structures, the shell and its support have been closely integrated so that reflector shell surface adjustment has not been available as a last stage of manufacture. As a consequence, adjustment of the reflector shell surface was difficult. Furthermore, since the shell and its support were closely integrated, distortion in one would be transmitted to the other. These problems were particularly apparent in reflectors which employ dual reflector surfaces, nested together.

Accordingly, there is need for a structure which permits the adjustment of a reflector surface as a final manufacturing step to optimize reflector surface curvature, together with a support structure which minimizes distortion of the reflector surface due to temperature change and temperature differential.

SUMMARY OF THE INVENTION

In order to aid in the understanding of this invention, it can be summarized that it is directed to a reflector shell adjustment structure wherein a support structure carries at least one reflector shell thereon, with adjustment structure attaching the reflector shell to the support structure so that, as a last step in the manufacturing process, the reflector shell is supported at optimum configuration and is securely attached to the support structure at that configuration. Two nested reflector shells can be mounted and adjusted with respect to the support structure.

It is, thus, a purpose and advantage of this invention to provide a reflector shell adjustment structure where the surface of the shell is retained at an optimum configuration with respect to a support structure by adjustment of the surface shape as a last element of manufacture.

It is another purpose and advantage of this invention to provide a basic support structure upon which are mounted first and second nested reflector shells each having a reflective surface, together with adjustment and attachment structure interengaging the shells with the support structure for adjustment of the shape of the reflector surface, followed by a method of securing the surface in the desired configuration.

It is another purpose and advantage of this invention to provide a support structure on which is mounted at least one reflector shell having a reflective surface, with the support structure and shell each being configured and being attached together in such a manner that temperature changes and temperature differentials across the structure cause a minimal amount of change in the configuration of the reflector surface.

Other purposes and advantages of this invention will become apparent from a study of the following portion of the specification, the claims and the attached drawings.

DESCRIPTION OF THE PREFERRED EMBODIMENT

Figure 1:
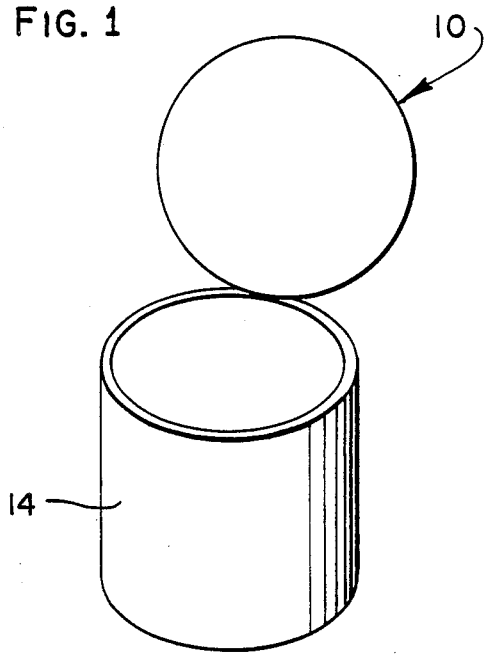
FIG. 1 is an isometric view of a device upon which the structure of this invention is useful.
Figure 3:
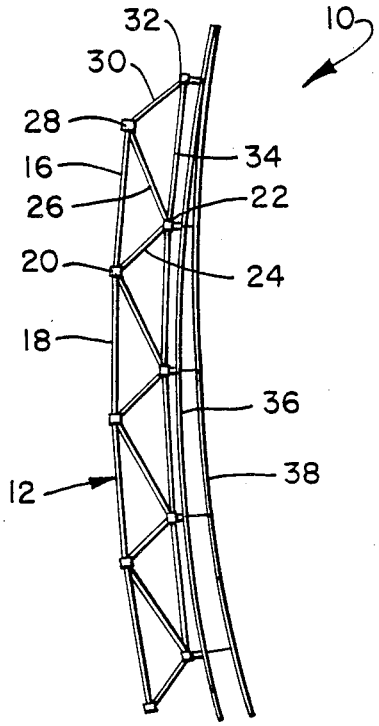
FIG. 3 is an offset section through the reflector shell and support structure assembly.
Figure 2:
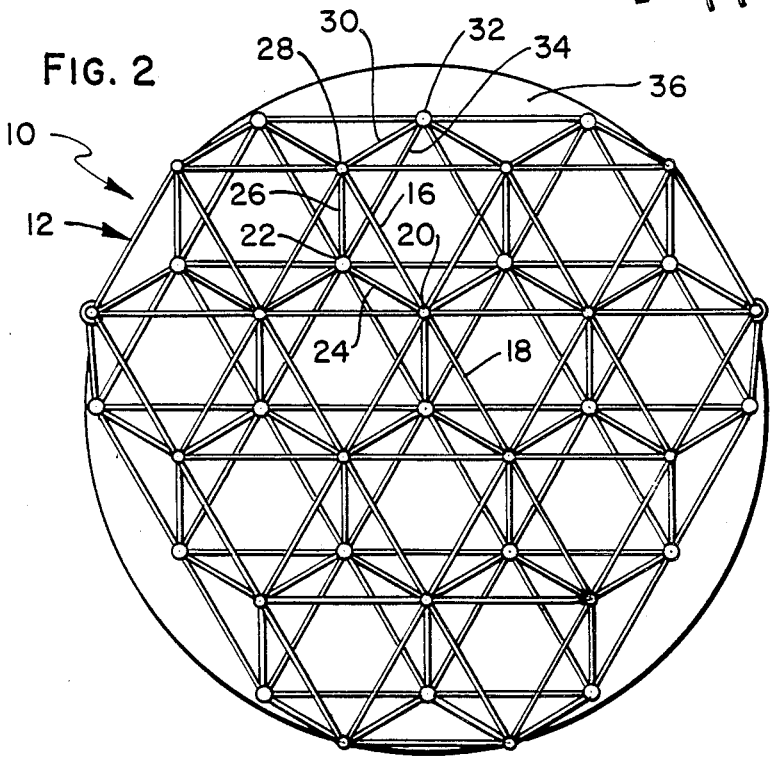
FIG. 2 is a plan view of a support structure for the reflector shells.
Figure 4:
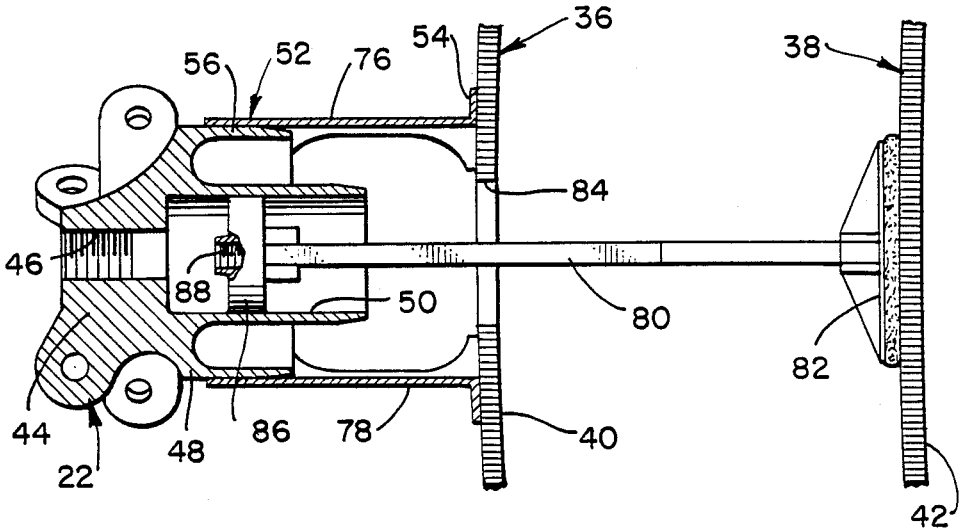
FIG. 4 is an enlarged center-line section through one of the adjustment structure which support the reflector shells from the support structure.
Figure 5:
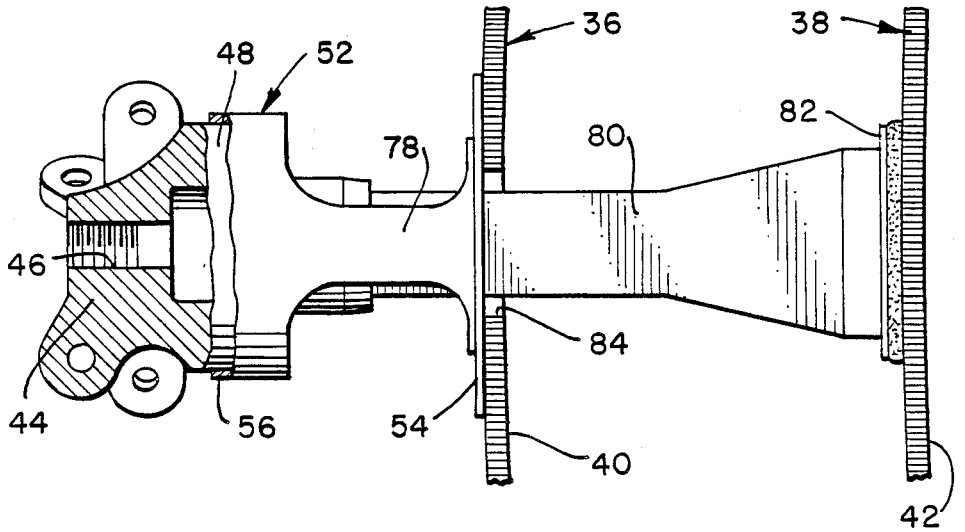
FIG. 5 is a side view of the structure shown in FIG. 4, with center-line sections and broken sections.

In FIGS. 1, 2 and 3, an antenna structure embodying the reflector shell adjustment structure of this invention is generally indicated at 10. The support structure 12 is a dynamically rigid truss structure. The truss structure is mounted upon base 14, which carries the radio-frequency transmitter and/or receiver. The base may be any conventional ground structure or may be a satellite in space. The truss structure provides the necessary strength rigidity to withstand the loads encountered during satellite launch and provides the structural and thermal stability needed for temperature changes and temperature differentials found in orbit and in other locations. The truss support structure may be made very light by the employment of tubular truss members of continuous fiber composite material such as graphite in an epoxy matrix. When weight is not critical, the truss may be made of other materials. The junction between truss rods on the back of the support structure is at simple nodal fittings which join a plurality of the truss rods at the node. For example, truss rods 16 and 18 are joined at node 20. In FIGS. 2 and 3, these truss rods are seen to be at the back of the support structure. Also joined at node 20 are truss rods which reach forward in the truss to attach forward nodes. Forward node 22 is seen in FIGS. 2 and 3, with truss rod 24 joining nodes 20 and 22, truss rod 26 joining nodes 22 and 28, truss rod 30 joining nodes 28 and 32, and truss rod 34 joining nodes 22 and 32 at the forward part of the truss. The nodes 22, 32 and the other nodes along the forward face of the truss, as seen in FIGS. 2 and 3, provide the interconnection point at which the adjustment structures attach to the truss to support reflector shells 36 and 38. For strong, yet lightweight construction, the shells are preferably made with a honeycomb sandwich construction. The forward faces 40 and 42 in FIGS. 4 and 5 are the reflector surfaces which have the critical surface shape which is to be initially adjusted and then maintained, in accordance with the structure of this invention. The two reflectors may be fed with radio waves with different polarizations, and the front shell 38 and its reflective surface 42 are constructed so that they are substantially transparent to the energy reflected off of surface 40. Thus, the two reflector shells can be nested to provide double use for the same truss and conserve space.

The truss rods terminate in rod ends which are pinned at the nodal fittings. Forward node 22 is illustrated in more detail in FIGS. 4, 5, 6 and 7 and show the lugs at which the truss rods are pinned. The shells of the double surface reflector are independently attached to the dynamically rigid truss structure by means of studs at each of the forward nodes. Each of the forward nodes has a body, with the body of node 22 generally indicated at 44, as seen in FIGS. 4 and 5. The body has a central bore 46 which is threaded for temporary receipt of an adjustment tool, as described hereinafter. The bore defines the central axis of the body. The body has lugs thereon by which the truss rods are pinned to the body. The body has an exterior right circular cylindrical engagement surface 48 and an interior right circular cylindrical engagement surface 50. Both of these surfaces are coaxial with the central axis of the body, as defined by bore 46.

Figure 6:
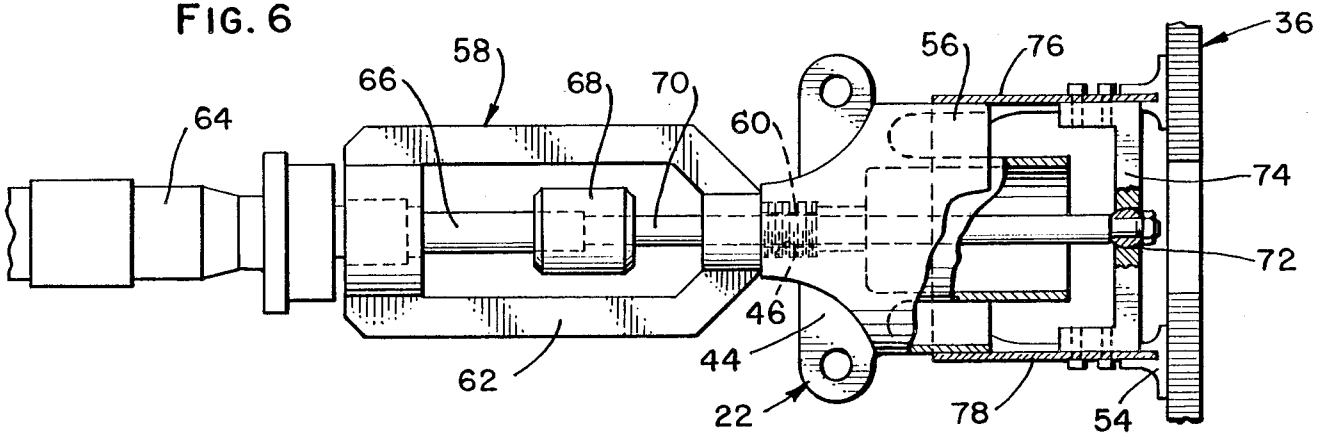
FIG. 6 is a side-elevational view, similar in orientation to FIG. 4, showing the tooling used in the adjustment of the back reflector shell with respect to the support structure.

Rear shell stud 52 has a forward outwardly extending flange 54 which is bonded to the back surface of the rear reflector shell 36. The interior surface of the rear shell stud 52 is in the form of a right circular cylinder sized to be a slip fit onto the engagement surface 48, as shown in FIG. 4. The interface 56 between the stud interior surface and engagement surface needs only to be adhesive bonded to secure body 44 to rear shell 36. However, before adhesive is placed in this interface, the position of the shell may be adjusted with respect to the truss. To accomplish this adjustment, the rear shell adjustment tool 58 is temporarily installed for the adjustment process, see FIG. 6. A similar tool is installed at each of the forward nodes so that the entire shell configuration can be adjusted at one time. Rear shell adjusting tool 58 has a forward threaded boss 60 on yoke 62. Micrometer adjustor 64 is threaded into the rear end of the yoke and has a forward extending rod 66. Rod 66 can be adjusted forward and back along the axis of bore 46 in small increments. Swivel coupling 68 couples rod 66 to adjusting rod 70, which extends down through the open center of yoke 62. Adjusting rod 70 carries ball 72 on its forward end, which is mounted in a corresponding socket in bridge 74. As is best seen in FIG 6, a portion of the cylindrical section of the rear shell stud 52 is shaped by cutting away a portion of the tube between the interface 56 and flange 54 to provide a view to the interior of the tube and to define two legs 76 and 78. Bridge 74 is mounted between these legs and is secured thereto by means of removable machine screws extending through the legs and into the bridge, as shown in FIG. 6.

With all of the rear shell adjusting tools 58 in place, the rear reflector shell 36 is adjusted to an optimized position. The truss is independent of other structure and thus serves as a secure stable reference for carrying the rear reflector shell and holding it in the desired optimized position. The shell 36 is originally manufactured to approximate the desired configuration, usually a parabola for transmission of a spot beam. The shell will have inherent distortion due to manufacturing and material limitations. The postmanufacturing adjustment when the shell is mounted on its supporting truss reduces this distortion to improve the shellp3 s performance. The amount of adjustment necessary to optimize performance may be determined by adjusting the shell during electrical performance tests. Adjustment at each of the studs brings the reflective surface of the rear shell into the optimized configuration. When the optimal configuration is reached, adhesive is fed into the interface 56 of each stud to hold the rear shell in place with respect to the truss.

As is seen in FIG. 4, forward shell 38 is located in place and studs are secured thereto at each of the forward nodes. As seen in FIGS. 4 and 5, forward stud 80 is a flat stud with a rectangular cross section of fairly high aspect ratio to give strength within the plane of the stud and permit flexibility in the direction perpendicular to the plane of the stud. The forward portion of the stud carries flange 82, which is bonded to the back of forward shell 38. Forward stud 80 extends back through an opening 84 into the space within interior engagement surface 50. The rearward end of forward stud 80 carries plunger 86 thereon, which has a slip fit within interior engagement surface 50. Plunger 86 has threaded adjustor attachment hole 88 in line with and facing bore 46.

Figure 7:
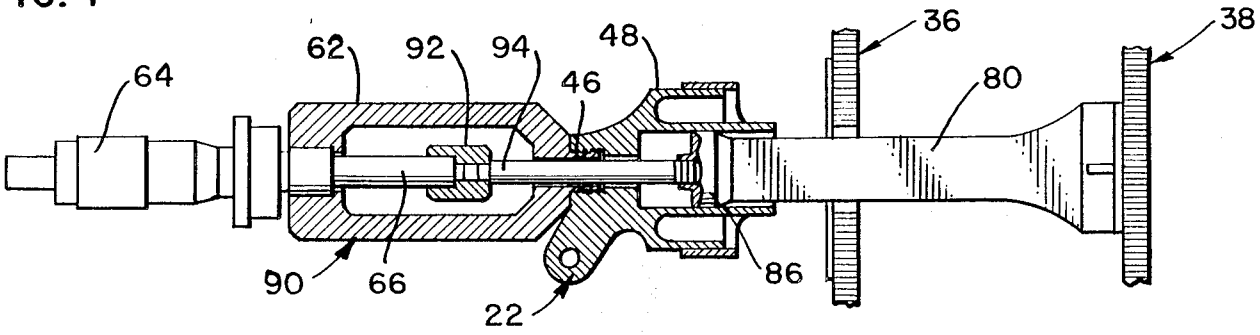
FIG. 7 is a view similar to FIG. 5, on reduced scale, showing the tooling used in adjusting the forward reflector shell.

Forward shell adjustment tool 90, seen in FIG. 7, has the same yoke 62 and micrometer adjustor 64. The forward end of the yoke is threaded into bore 46. The rod 66 of the micrometer adjustor carries swivel coupling 92 by which the micrometer rod 66 is coupled to adjusting rod 94. The adjusting rod 94 is, in turn, threaded into the adjustment hole 88 in plunger 86. If necessary, couplings 68 and 92 can incorporate swivels to permit relative rotation.

By this means, the position of stud 80 can be adjusted with respect to node 22. A similar adjustment tool is provided at each of the nodes, and the forward shell 38 is adjusted to its most desirable configuration. When in the optimum configuration, adhesive is fed into the interface space between surface 50 and plunger 86, to permanently hold the forward shell in position with respect to node 22, and thus the balance of the truss. Thereupon, the adjustment tools are removed and the manufacturing for the dish structure is complete.

In addition to permitting individual adjustment at each of the forward nodes, the stud structure is arranged for minimum transfer of distortion between each of the shells and the truss structure. Such distortion occurs due to temperature changes and temperature differences across the structure. Each of the dishes is a surface of revolution, probably parabolic or close to parabolic, as previously discussed. The legs 76 and 78 of stud 52 and the flat blade of forward stud 80 are each arranged so that the stiff planes thereof are normal to the radial direction of the normal axis at the center of the reflector surface. With this structure, radial flexure can be accomplished with a minimum of stress so that dimensional changes of the truss or either of the shells due to temperature changes or temperature differentials provides minimum interactive stress on the other components. With bulk temperature changes, most of the dimensional changes are in the radial direction so that flexure is achieved without significant stress. The structural coupling between the two shells is eliminated and the shells are allowed to expand radially from the center with minimal restraint. Secure mounting of the shells to the truss is achieved since the studs in different locations are arranged at different angles.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An antenna comprising:

forward and rear nested antenna shells, said antenna shells respectively having forward and rear reflective surfaces respectively on the front of said forward and rear nested antenna shells;

a shell supporting truss structure positioned behind at least a portion of said shells, a plurality of supporting nodes on said supporting truss structure;

a plurality of rear shell supporting studs extending from said rear shell respectively to said plurality of nodes on said truss to support said rear shell from said truss, said rear shell supporting studs being more stiff in one direction than in another direction; and a plurality of forward shell supporting studs extending between said forward shell respectively to said plurality of nodes on said truss, said forward shell supporting studs being more stiff in one direction than in another direction, said forward and rear studs engaging said nodes on sliding surfaces by which said studs slide toward and away from said nodes to adjust the position of said forward and rear shells with respect to said nodes and said truss, and adhesive on said sliding surfaces to secure said shells with respect to said truss, said forward shell supporting studs being independent of said rear shell supporting studs so that said forward and rear shells are independently supported from said truss by said studs, said rear shell supporting studs and said forward shell supporting studs being oriented so that the studs connected to the same shell are stiff in substantially the same direction.

2. The antenna structure of claim 1 wherein said studs are adjustable with respect to said truss so that the reflective surface contour can be adjusted during attachment of each of said shells with respect to said truss.

3. The antenna structure of claim 1 wherein each of said studs is independently adjustable with respect to a respective node so that each of said shells can be independently adjusted with respect to each respective node upon assembly of each of said shells with respect to said truss so as to optimize the contour of said reflective surface of said shells.

4. An adjustment structure comprising:

first and second members to be adjusted and supported;

a node, said node forming part of a framework, with respect to which said first and second members are to be adjusted;

first and second engagement surfaces on said node, said engagement surfaces extending generally towards said first and second members, said first engagement surface being a cylinder of revolution;

a first stud attached to said first member and in slidable engagement with said first engagement surface, said stud being a cylindrical tube cut away to form first and second legs;

a second stud attached to said second member and in sliding engagement with said second engagement surface, both said first and second studs having substantially flat portions and said substantially flat portions lying substantially parallel to each other, said legs of said first stud being substantially parallel to said flat portion of said second stud, said first stud being attached to said first engagement surface on said node and said second stud being attached to said second engagement surface on said node so that said first and second members can be adjusted by sliding toward and away from said node and attached with respect to said node.

5. The adjustment structure of claim 4 wherein said second stud has a portion of substantially rectangular cross section, said first and second members are each substantially surfaces of revolution about substantially the same axis, and portions of said studs are thicker in a direction normal to a radius from the axis of revolution than in a direction parallel to such a radius.

6. The adjustment structure of claim 5 further including adhesive on said engagement surfaces.

7. An adjustment structure comprising:

first and second members to be adjusted and supported;

a node, said node forming part of a framework with respect to which said first and second members are to be adjusted;

first and second engagement surfaces on said node, said engagement surfaces extending generally towards said first and second members;

a first and second members;

a first stud attached to said first member and in slidable engagement with said first engagement surface for sliding in a direction towards and away from said node;

a second stud attached to said second member and in sliding engagement with respect to said second engagement surface in a direction towards and away from said node, said first stud being slidably adjustable at said first engagement surface on said node for subsequent attachment thereto and said second stud being slidably adjustable at said second engagement surface on said node for subsequent attachement thereto so that said first and second members can be adjusted for sliding toward and away from said node and attached with respect to said node; and said members being first and second reflector shells each having an axis of revolution, and there is a truss upon which a plurality of nodes are mounted and there is an adjustment structure at each of said nodes so that said shells can be adjusted at a plurality of points to adjust the curvature of said shells.

8. The adjustment structure of claim 7 wherein both said first and second studs are substantially flat and lie substantially flat and lie substantially parallel to eah other.

9. An adjustment structure comprising:

first and second reflector shells each having an axis of revolution;

a plurality of nodes mounted on a truss so that said truss forms a framework upon which said plurality of nodes are mounted;

first and second engagement surfaces on each of node of said plurality of nodes each of said engagement surfaces providing adjustability of support for said first and second reflector shells to adjust the curvature of said shells, said engagement surfaces extending generally towards said first and second reflector shells;

a first stud attached to said first reflector shell and in slidable engagement with said first engagement surface, said first engagement surface being a cylinder of revolution and said first stud is a cylindrical tube cut away to form first and second legs;

a second stud attached to said second reflector shell and in sliding engagement with respect to said second engagement surface, said legs of said first stud being substantially parallel to said second stud, said first stud being attached to said first engagement engagement surface on a respective node and said second stud being attached to said second engagement surface on a respective node so that said first and second reflector shells can be adjusted by sliding toward and away from said node and attached with respect to said node.

10. The adjustment structure of claim 9 wherein said second stud is of rectangular cross section, said first and second reflector shells being surfaces and having an axis normal to the centers of the surfaces and said studs are thicker in a direction normal to a radius from said axis of revolution than in a direction parallel to such a radius.

11. The method of adjusting a reflector shell which is mounted upon a support having a plurality of nodes and an adjustment structure at each node and attached to the reflector shell, with the adjustment structure including a stud which has a portion which is substantially wider than it is thick, comprising the steps of:

attaching the stud to the reflector shell with a sliding surface on the stud in sliding engagement with a sliding surface on the node which is part of the adjustment structure;

grasping the stud and jacking it with respect to the node to cause sliding at the engagement of the surfaces to the desired position; and adhesively attaching the stud to the adjustment structure by adhesive attachment at the surfaces on the stud and node to secure the shell with respect to the node.

12. The method of claim 11 wherein the shell has an axis normal to the center of the shell and the stud is positioned so that it is thinner in the direction of a radius to the axis so that the shell can radially expand with low stress.

13. The method of claim 11 wherein the stud is a first stud and the engagement surface is a first engagement surface and there is additionally a second shell, a second stud and a second engagement surface on the adjustment structure and further including the steps of:

attaching the second stud on the second shell;

adjusting the second stud with respect to the node; and securing the second stud with respect to the node so that both of the shells are adjusted and secured with respect to the node.

14. The method of claim 13 wherein both shells have an axis of revolution and both shells have a center where the centers lie near each other and the attachment of studs to the shell includes the step of attaching the studs oriented in such a direction that they are thinner in the direction of a radius from the axis than normal to such a radius.

* * * * *